US009335730B2

(12) United States Patent
Kusudo et al.

(10) Patent No.: US 9,335,730 B2
(45) Date of Patent: May 10, 2016

(54) PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Ryoji Kusudo, Yokohama (JP); Ryota Shibuya, Yokohama (JP); Naoki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/693,236

(22) Filed: Apr. 22, 2015

(65) Prior Publication Data

US 2015/0309471 A1 Oct. 29, 2015

(30) Foreign Application Priority Data

Apr. 24, 2014 (JP) ..... 2014-090507

(51) Int. Cl.
*G03G 21/18* (2006.01)

(52) U.S. Cl.
CPC ..... *G03G 21/1825* (2013.01); *G03G 21/1821* (2013.01)

(58) Field of Classification Search
CPC ..... G03G 21/1814; G03G 21/181; G03G 2221/1807
See application file for complete search history.

(56) References Cited

U.S. PATENT DOCUMENTS 7,072,603 B2 * 7/2006 Tsuzuki ..... G03G 21/1821 399/111
2003/0231897 A1 * 12/2003 Dougherty ..... G03G 21/181 399/111
2009/0297219 A1 * 12/2009 Yoshino ..... G03G 21/1828 399/114

FOREIGN PATENT DOCUMENTS

JP 2000-019800 A 1/2000
JP 2013-020233 A 1/2013

* cited by examiner

*Primary Examiner* — Sandra Brase
(74) *Attorney, Agent, or Firm* — Canon USA, Inc. IP Division

(57) ABSTRACT

A process cartridge attachable/detachable to/from an apparatus main body of an electrophotographic image forming apparatus is configured such that the photosensitive unit and the development unit are coupled with each other at both ends in a direction parallel to a rotational center axis line of the photosensitive drum. Guide units are provided at one end of the photosensitive unit and at one end of the development unit, which are separated from each other when an external force does not work on the process cartridge. When the process cartridge is subjected to an impact in a direction in which the development roller approaches the photosensitive drum, the guide units are brought into contact with each other while the development unit rotates relative to the link member, and guide the development unit in a direction in which the development roller separates from the photosensitive drum.

12 Claims, 16 Drawing Sheets

PROCESS CARTRIDGE AND ELECTROPHOTOGRAPHIC IMAGE FORMING APPARATUS

BACKGROUND OF THE INVENTION

1. Field of the Invention

The present invention relates to a process cartridge attachable/detachable to/from an apparatus main body, and an electrophotographic image forming apparatus. The process cartridge is configured such that an electrophotographic photoreceptor and a development device working on the electrophotographic photoreceptor are integrated in a cartridge, which is attachable/detachable to/from the electrophotographic image forming apparatus main body. The development device has a development roller and is configured to visualize an electrostatic latent image formed on the electrophotographic photoreceptor by the development roller by use of a development agent. Further, the electrophotographic image forming apparatus is configured to form an image on a recording medium by use of an electrophotographic image forming system. Examples of the electrophotographic image forming apparatus include electrophotographic copying machine, electrophotographic printer (such as a light-emitting diode (LED) printer or laser beam printer), facsimile, word processor, and the like.

2. Description of the Related Art

A process cartridge includes a photosensitive unit having a photosensitive drum, and a development unit having a development roller for developing an electrostatic latent image formed on the photosensitive drum. The photosensitive unit and the development unit are coupled with each other at both ends in a direction parallel to a rotational center axis of the photosensitive drum. An electrophotographic image forming apparatus in a non-contact development system is configured such that a slight gap is formed between the surface of the photosensitive drum and the surface of the development roller. In this case, for example, rollers (interval holding members) each having a slightly larger diameter than the development roller are provided at both ends of the development roller and the pair of rollers always contacts the photosensitive drum. Thereby, a distance between the surface of the drum and the surface of the development roller can be kept constant. In such a technique, the photosensitive unit and the development unit are typically coupled at one end to give a certain degree of freedom to their motions in the direction parallel to the rotational center axis line to always bring the pair of rollers into contact with the photosensitive drum. Thereby, even if a dimensional error is present in various members, the development unit gives a force to the photosensitive unit by using a force giving member such as spring, so that the pair of rollers can always contact the photosensitive drum. There is known a technique for coupling the photosensitive unit and the development unit by a link member rotatably coupled to both of them to couple the units giving a certain degree of freedom to their motions (see Japanese Patent Application Laid-Open No. 2013-20233 Publication).

However, the process cartridge with the above structure has a problem that if the process cartridge packaged in a box is dropped during transportation, the development roller and the photosensitive drum collide with each other and the surface of the photosensitive drum is damaged. That is, the photosensitive drum has a large diameter and is light while the development roller has a smaller diameter and is heavy due to a magnet disposed therein. Thus, the development roller is elongate and heavy, and more flexible than the photosensitive drum. Therefore, when subjected to an impact, the development roller largely bends and collides with the surface of the photosensitive drum. There is known a technique for providing a protective sheet between the photosensitive drum and the development roller to address such a problem (see Japanese Patent Application Laid-Open No. 2000-019800 Publication). Further, there is known, as other solution, a method for enhancing a performance of a buffer material to alleviate an impact on the process cartridge during transportation.

However, the technique for providing a protective sheet needs to add a protective sheet only for the case of transportation, which remarkably increases the number of components and needs a step of incorporating a protective sheet into the process cartridge during its assembly. In order to enhance a performance of the buffer material, a highly-functional buffer material needs to be employed or a size of the buffer material needs to be increased, which causes an increase in cost.

It is required to restrict a collision between the development roller and the photosensitive drum while preventing an increase in cost without increasing the number of components.

SUMMARY OF THE INVENTION

According to an aspect of the present invention, a process cartridge attachable/detachable to/from an apparatus main body of an electrophotographic image forming apparatus, includes a photosensitive unit having a photosensitive drum, a development unit having a development roller for developing an electrostatic latent image formed on the photosensitive drum, and force giving members configured to give a force to the photosensitive unit and the development unit in a direction in which the photosensitive drum and the development roller approach each other. The process cartridge is configured such that the photosensitive unit and the development unit are coupled with each other at both ends in a direction parallel to a rotational center axis line of the photosensitive drum, wherein the photosensitive unit and the development unit are coupled with each other by a link member rotatably supported on the photosensitive unit and rotatably supported also on the development unit at one end in the direction parallel to the rotational center axis line. Guide units are provided at one end of the photosensitive unit and at one end of the development unit, which are separated from each other when an external force does not work on the process cartridge. When the process cartridge is subjected to an impact in a direction in which the development roller approaches the photosensitive drum, the guide units are brought into contact with each other while the development unit rotates relative to the link member, and are configured to guide the development unit in a direction in which the development roller separates from the photosensitive drum.

Further features of the present invention will become apparent from the following description of exemplary embodiments with reference to the attached drawings. Further features of the present invention will become apparent from the following description of exemplary embodiments (with reference to the attached drawings).

DESCRIPTION OF THE EMBODIMENTS

Exemplary embodiments according to the present invention will be described below in detail by way of example with reference to the drawings. The scope of the present invention is not limited to the dimensions, materials, shapes and relative arrangements of the components described in the exemplary embodiments unless particularly stated.

A process cartridge and an electrophotographic image forming apparatus according to a first exemplary embodiment of the present invention will be described with reference to FIGS. 1 to 15. In the following description, a process cartridge will be simply referred to as "cartridge", an electrophotographic image forming apparatus will be simply referred to as "image forming apparatus", and an electrophotographic photosensitive drum will be simply referred to as "drum." The image forming apparatus excluding the cartridge will be simply referred to as "apparatus main body." A direction parallel to a rotational center axis line of the photosensitive drum will be referred to as "longitudinal direction." Further, a side where the drum receives a drive force from the apparatus main body in the longitudinal direction will be referred to as "drive side" a side opposite to the side where the drum receives a drive force from the apparatus main body in the longitudinal direction, will be referred to as "non-drive side."

<Image Forming Apparatus>

Figure 2:
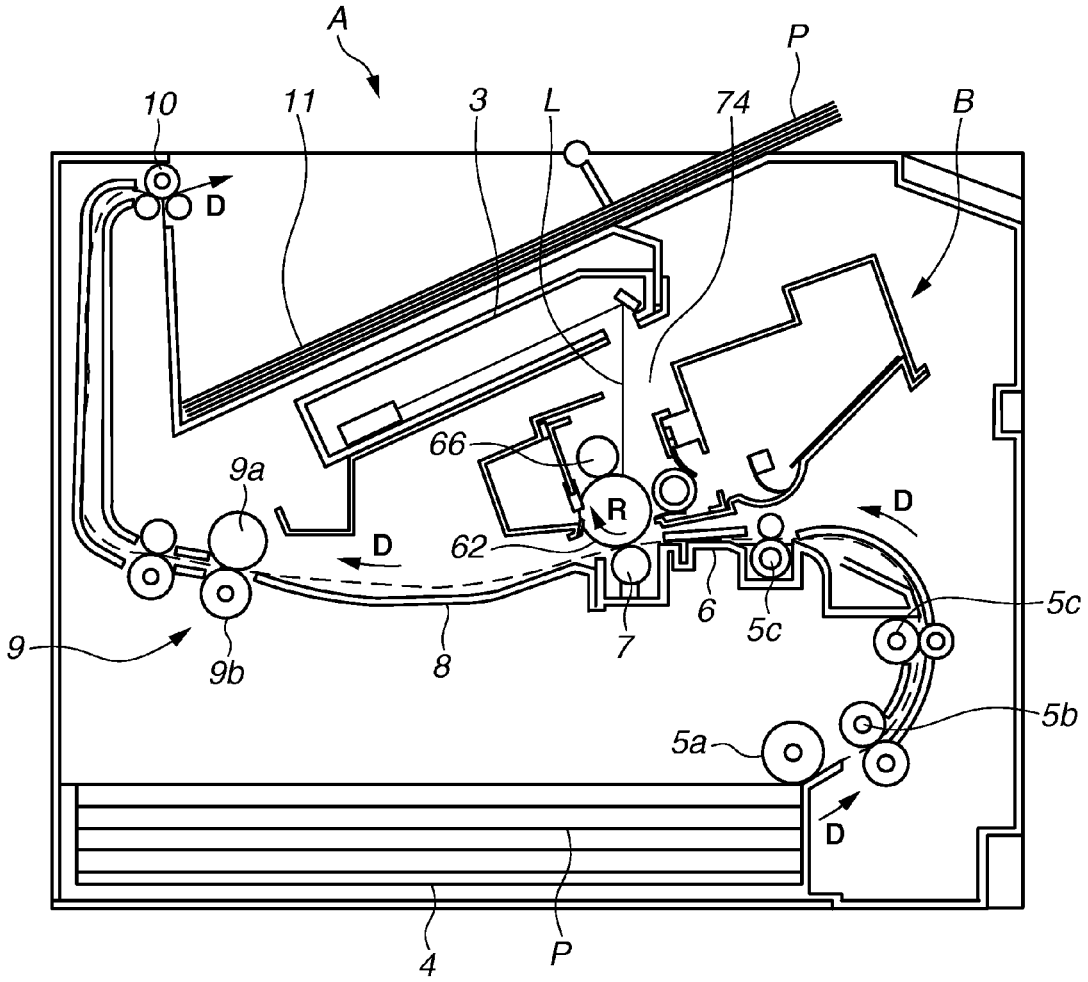
FIG. 2 is a schematic cross-section view of an image forming apparatus according to the first exemplary embodiment.
Figure 3:
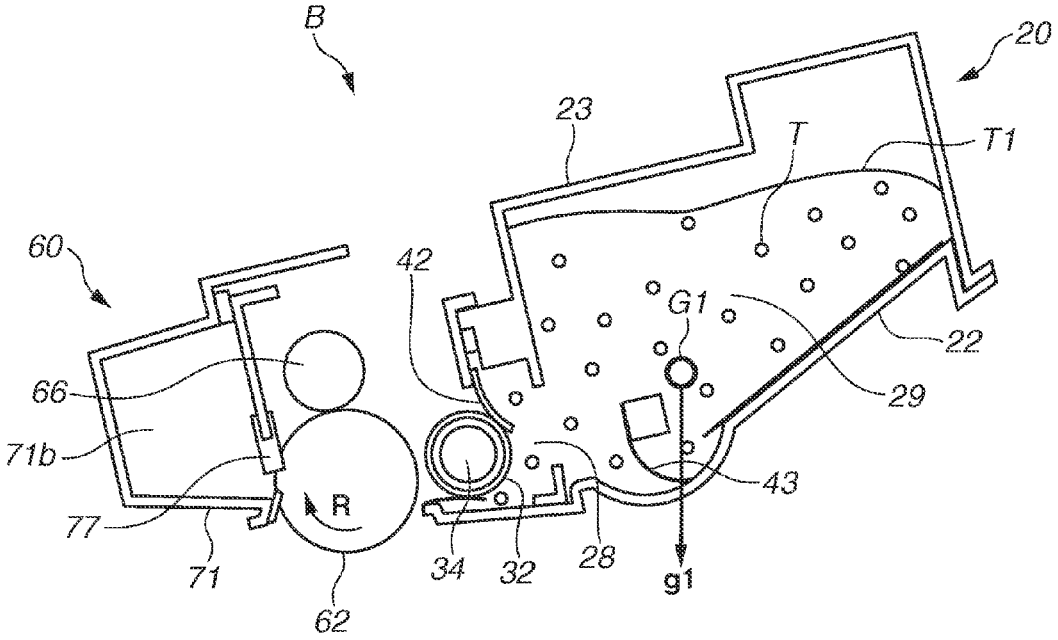
FIG. 3 is a schematic cross-section view of the process cartridge according to the first exemplary embodiment.

An entire structure of the image forming apparatus will be schematically described with reference to FIGS. 2 and 3. FIG. 2 is a schematic cross-section view of the image forming apparatus according to the present exemplary embodiment. The image forming apparatus according to the present exemplary embodiment includes an apparatus main body A and a cartridge B. FIG. 3 is a schematic cross-section view of the cartridge B according to the present exemplary embodiment.

The image forming apparatus according to the present exemplary embodiment is a laser beam printer using an electrophotographic technique, and is configured such that the cartridge B is attachable/detachable to/from the apparatus main body A. An exposure device 3 (laser scanner unit) is arranged over the cartridge B. A sheet tray 4 stores recording mediums (which will be referred to as sheet materials P below) on which an image is formed. The sheet tray 4 is arranged below the cartridge B. A pickup roller 5*a*, a feeding roller pair 5*b*, a conveyance roller pair 5*c*, a transfer guide 6, a transfer roller 7, a conveyance guide 8, a fixing device 9, a discharge roller pair 10, and a discharge tray 11 are sequentially arranged in a conveyance direction D of the sheet materials P in the apparatus main body A. The fixing device 9 includes a heating roller 9*a* and a pressure roller 9*b*.

<Image Forming Process>

An image forming process will be schematically described below. A drum 62 is rotationally driven at a predetermined circumferential speed in the arrow R direction in response to a print start signal. A charge roller 66 biased with a bias voltage contacts the outer periphery of the drum 62 and uniformly charges the outer periphery of the drum 62. The exposure device 3 outputs a laser light L according to image information. The laser light L passes through an exposure window 74 on the top of the cartridge B, and, scans and exposes the outer periphery of the drum 62 to the laser light. Thereby, an electrostatic latent image corresponding to the image information is formed on the outer periphery of the drum 62.

On the other hand, in a development unit 20, a toner T in a toner chamber 29 is conveyed while being stirred due to rotation of a conveyance member 43, and is fed to a toner supply chamber 28. The toner T is carried on the surface of a development roller 32 by a magnetic force of a magnet roller 34 (stationary magnet). Thickness of toner T is regulated on the periphery of the development roller 32 while abrade-charged by a development blade 42. The toner T is transferred to the electrostatic latent image formed on the drum 62 and the electrostatic latent image is visualized as a toner image. A sheet material P housed in the lower part of the apparatus main body A is fed from the sheet tray 4 in the arrow D direction shown in the drawing, by the pickup roller 5*a*, the feeding roller pair 5*b*, and the conveyance roller pair 5*c* concurrently at an output timing of the laser light L. The sheet material P is supplied to a transfer position between the drum 62 and the transfer roller 7 via the transfer guide 6. The toner image is sequentially transferred from the drum 62 onto the sheet materials P at the transfer position. The sheet material P onto which the toner image is transferred is separated from the drum 62 and is conveyed to the fixing device 9 along the conveyance guide 8. The sheet material P passes through a nip between the heating roller 9*a* and the pressure roller 9*b* both constituting the fixing device 9. A fixing processing by pressure and heating is performed in the nip and the toner image is fixed on the sheet material P. The sheet material P on which the toner image is fixed is conveyed to the discharge roller pair 10 and is discharged to the discharge tray 11.

After the transfer is performed, the drum 62, from which the remaining toner on the outer periphery is removed by a cleaning blade 77, is used for the image forming process again. The toner T removed from the drum is stored in a discarded toner chamber 71*b* in a photosensitive unit 60.

<Attachment/Detachment of Cartridge to/from Apparatus Main Body>

Figure 4:
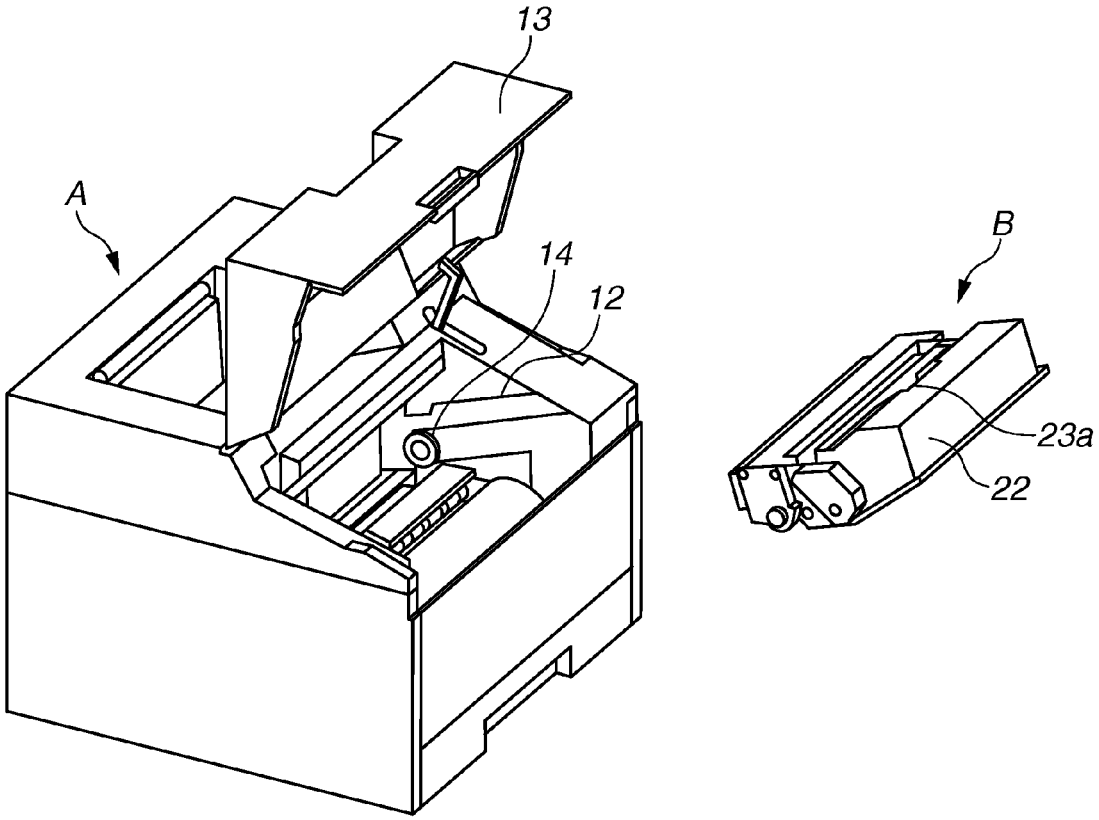
FIG. 4 is an explanatory diagram of how to attach/detach the process cartridge according the first exemplary embodiment.

Attachment/detachment of the cartridge B to/from the apparatus main body A will be described particularly with reference to FIG. 4. FIG. 4 is an explanatory diagram of how to attach and detach the process cartridge according to the present exemplary embodiment. In FIG. 4, the apparatus main body A with an open/close door 13 which is opened and the unmounted cartridge B are illustrated in the perspective view. The open/close door 13 is rotatably attached to the apparatus main body A. Guide rails 12 are provided on the drive side and the non-drive side in the apparatus main body A, respectively. A user inserts the cartridge B along the guide rails 12 while holding a grip part 23*a* of the cartridge B, thereby mounting the cartridge B on the apparatus main body A. A drive shaft 14 driven by a motor (not illustrated) provided in the apparatus main body A is engaged with a drive force receiving unit 63*a* (see FIG. 5) provided in the cartridge B. Thereby, the drum 62 coupled with the drive force receiving unit 63*a* rotates in response to a drive force from the apparatus main body A. Further, the charge roller 66 and the development roller 32 are powered by a power supply unit (not illustrated) in the apparatus main body A.

<Cartridge>

Figure 5:
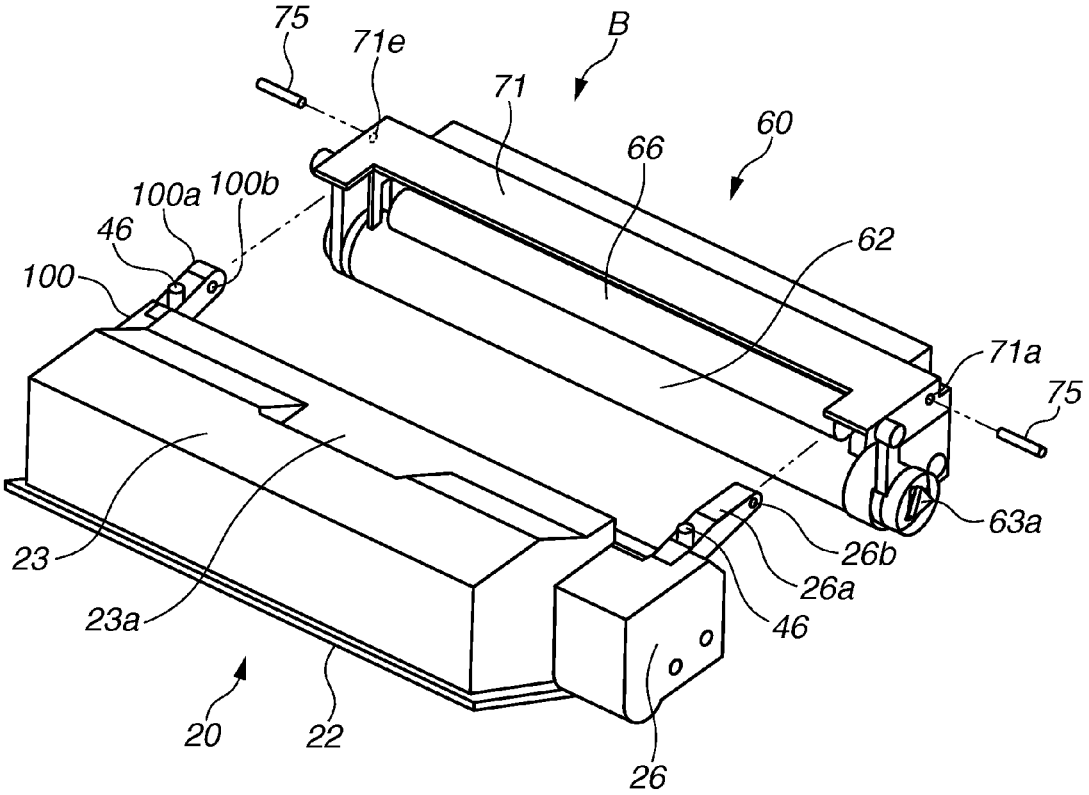
FIG. 5 is an explanatory diagram of how to assemble the process cartridge according to the first exemplary embodiment.
Figure 6B:
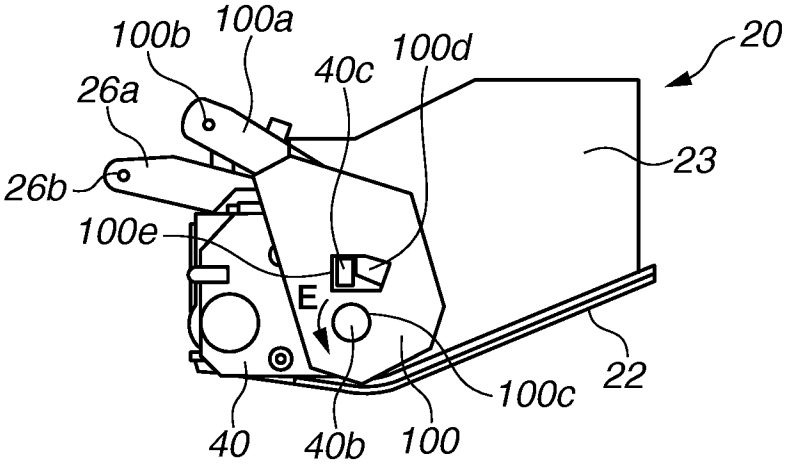
FIGS. 6A and 6B are the side views of a development unit according to the first exemplary embodiment.
Figure 6A:
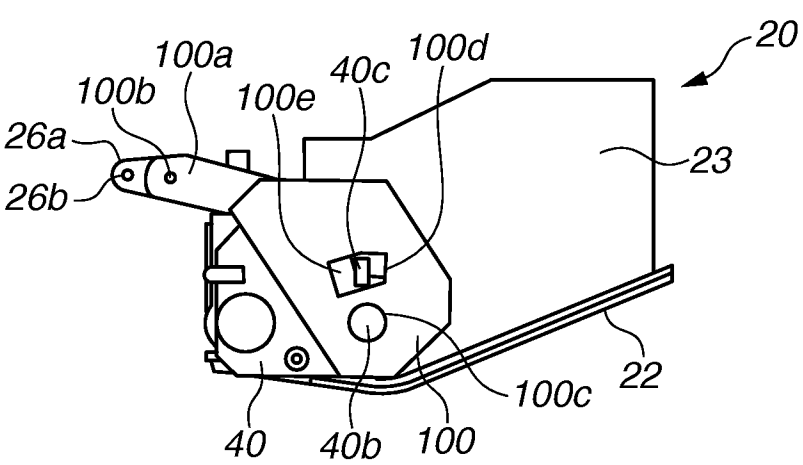
Figure 7:
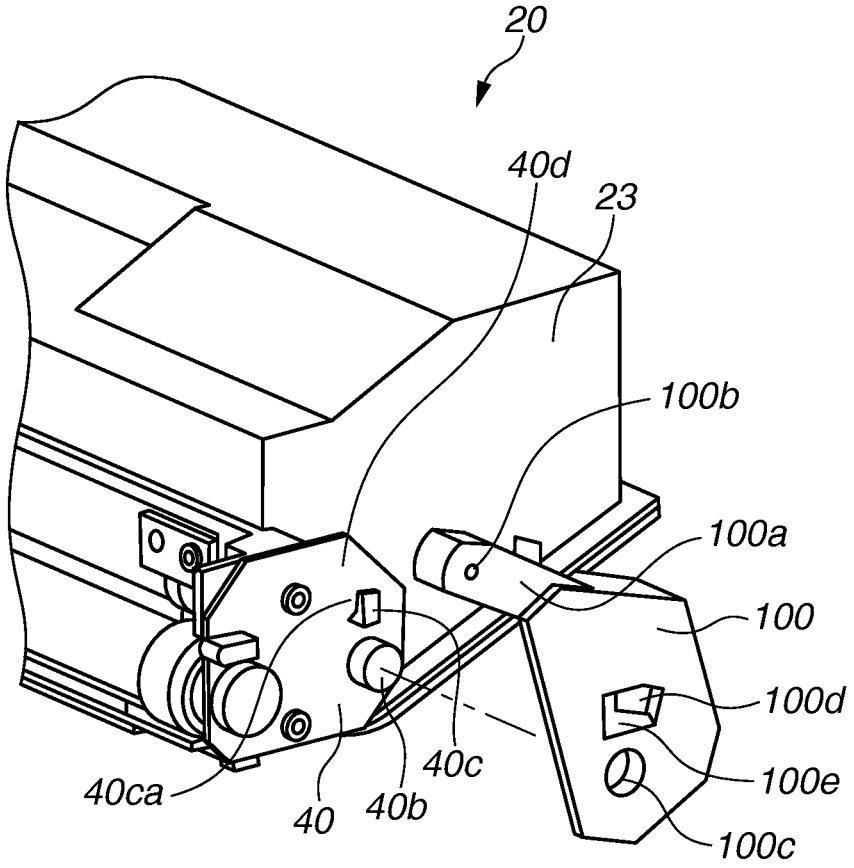
FIG. 7 is a perspective view of the development unit according to the first exemplary embodiment.

An entire structure of the cartridge B will be described particularly with reference to FIGS. 3 and 5 to 7. FIG. 5 is an explanatory diagram of how to assemble the cartridge B according to the present exemplary embodiment. FIG. 5 illustrates how to assemble the photosensitive unit and the development unit 20 as viewed from the drive side in a perspective view. FIG. 6 is a side view of the development unit 20 according to the present exemplary embodiment, and FIG. 7 is a perspective view of the development unit 20 according to the present exemplary embodiment. FIGS. 6 and 7 are the diagrams in which the development unit 20 is viewed from the non-drive side.

The cartridge B is configured such that the photosensitive unit 60 is coupled with the development unit 20. The photosensitive unit 60 includes a cleaning frame 71, the drum 62, the charge roller 66, and the cleaning blade 77. The development unit 20 includes a bottom member 22, a development container 23, a link member 100, a side member 26, the development blade 42, the development roller 32, the magnet roller 34, a conveyance member 43, a toner T, and an urging member 46 as force giving member.

The photosensitive unit 60 and the development unit 20 are coupled with each other at both ends in a direction parallel to the rotational center axis line of the drum 62. The coupling structure at one end (the non-drive side in the present exemplary embodiment) is different from the coupling structure at the other end (the drive side in the exemplary embodiment). At one end, the photosensitive unit 60 and the development unit 20 are coupled with each other at a certain degree of freedom of movement. More specifically, at one end, the photosensitive unit 60 and the development unit 20 are coupled with each other via the link member 100 which is rotatably supported on the photosensitive unit 60 and is rotatably supported also on the development unit 20. The coupling structures at both ends will be described below in more detail.

An attachment structure of the link member 100 to the development unit 20 will be first described. In the development unit 20, the development container 23 is provided integrally with a bearing member 40. The bearing member 40 is formed with a shaft 40*b* and a regulating unit 40*c* for regulating movements in the longitudinal direction of the link member 100. The link member 100 is provided with a hole 100*c* fitting with the shaft 40*b* of the bearing member 40, and an engagement part 100*d*. The engagement part 100*d* is regulated in its movements in the longitudinal direction by the regulating unit 40*c* of the bearing member 40. How to fit the link member 100 into the bearing member 40 will be described. At first, the hole 100*c* of the link member 100 is fit into the shaft 40*b* of the bearing member 40. At this time, as illustrated in FIG. 6B, the regulating unit 40*c* of the bearing member 40 is inserted into a rectangular hole 100*e* of the link member 100. The link member 100 is rotated in the arrow E direction in FIG. 6B so that the engagement part 100*d* of the link member 100 is inserted into a groove 40*ca* (FIG. 7) formed of a side wall 40*d* and the regulating unit 40*c* of the bearing member (FIG. 6A). In this way, the development unit 20 is coupled with the photosensitive unit 60 while the link member 100 is being attached.

The coupling structures between the development unit 20 attached to the link member 100, and the photosensitive unit 60 will be described below. The link member 100 is attached at one end in the longitudinal direction of the development unit 20, and the side member 26 is provided at the other end. The link member 100 and the side member 26 are provided with arms 100*a* and 26*a*, respectively. Through-holes 100*b* and 26*b* running parallel in the longitudinal direction are provided at the tips of the arms 100*a* and 26*a*, respectively. Fitting holes 71*e* and 71*a* for fitting a coupling member 75 therein are formed at both ends in the longitudinal direction of the cleaning frame 71. The coupling member 75 is fit into the fitting hole 71*e* to penetrate through the through hole 100*b* at one end while the arms 100*a* and 26*a* are aligned at predetermined positions of the cleaning frame 71. The coupling member 75 is fit into the fitting hole 71*a* to penetrate through the through hole 26*b* at the other end. Thereby, the photosensitive unit 60 and the development unit 20 are coupled with each other to be rotatable about the coupling member 75. At this time, the development unit is urged toward the photosensitive unit 60 about the coupling member 75 by the urging members 46 attached to the arms 100*a* and 26*a*. In this way, forces are exerted on the photosensitive unit 60 and the development unit 20 by the urging members 46 in a direction in which the drum 62 and the development roller 32 approach each other. The cartridge B according to the present exemplary embodiment is configured such that the rotational center axis of the coupling member 75 is shifted between one end and the other end as viewed in the longitudinal direction. That is, there is configured such that the rotational center axis of the coupling member 75 at one end and the rotational center axis line of the coupling member 75 at the other end are not on a same straight line.

<Photosensitive Unit>

Figure 8:
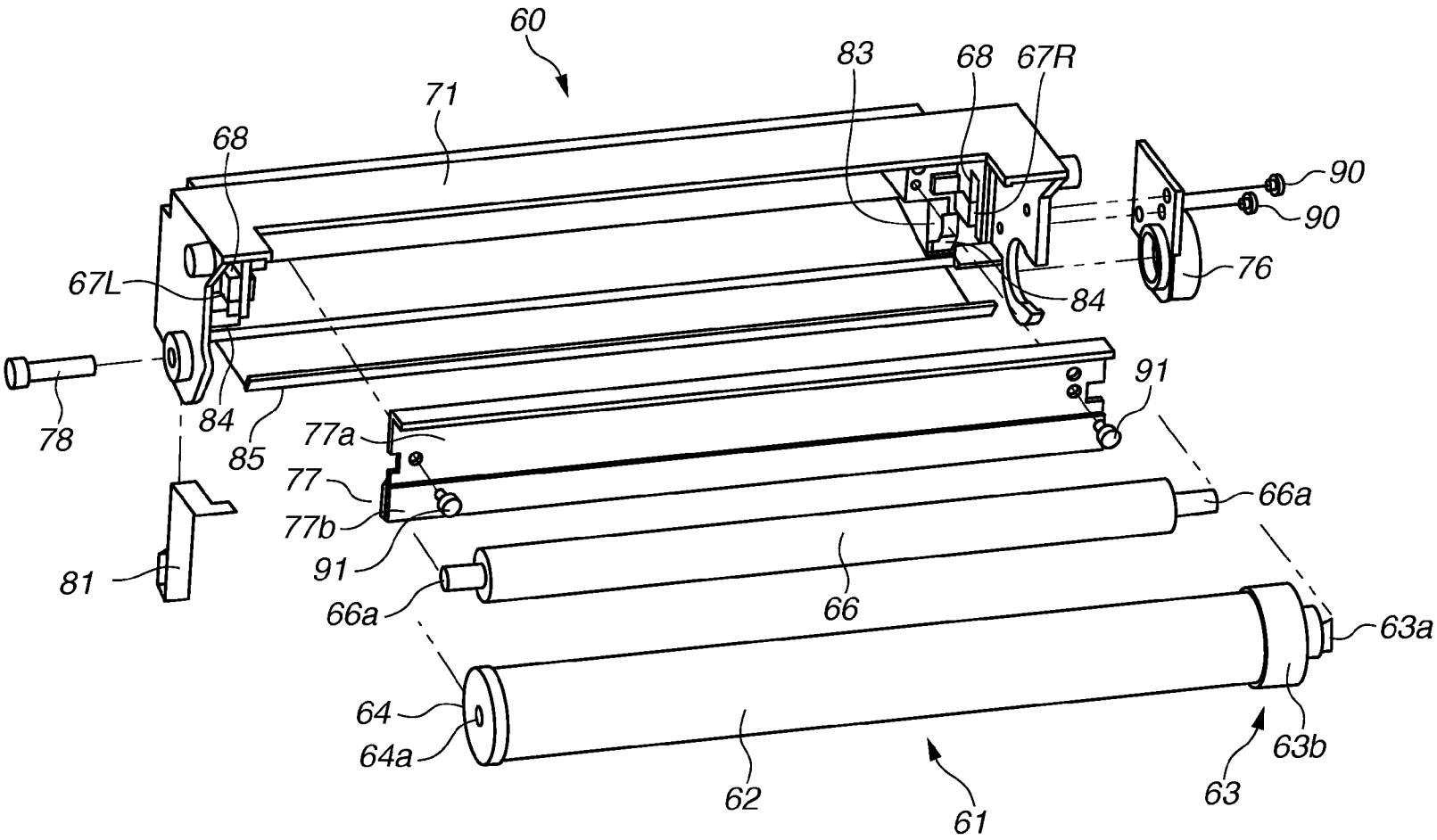
FIG. 8 is an exploded perspective view of the components of a photosensitive unit according to the first exemplary embodiment.

A structure of the photosensitive unit 60 will be described particularly with reference to FIG. 8. FIG. 8 is an exploded perspective view of the components of the photosensitive unit 60 according to the present exemplary embodiment. The cleaning blade 77 includes a support member 77*a* made of sheet metal and an elastic member 77*b* made of elastic material such as urethane rubber. Both ends of the support member 77*a* are fixed by screws 91 so that the cleaning blade 77 is fixed to the cleaning frame at a predetermined position. The elastic member 77*b* contacts the drum 62 and serves to remove remaining toner from the outer periphery of the drum 62. The removed toner is stored in the discarded toner chamber 71*b* (FIG. 3) of the photosensitive unit 60. A first seal member 83, a second seal member 84, and a third seal member 85 are provided at predetermined positions of the cleaning frame 71. The first seal member 83 prevents the discarded toner from leaking from both ends in the longitudinal direction of the elastic member 77*b* of the cleaning blade 77. The second seal member 84 prevents the discarded toner from leaking from both ends in the longitudinal direction of the elastic member 77*b* of the cleaning blade 77 and rubs adherents such as toner on the drum 62. The third seal member 85 is provided to contact the drum 62 in the longitudinal direction, and prevents the discarded toner from leaking from an upstream side in the rotation direction of the drum 62 with respect to the cleaning blade 77.

The cleaning frame 71 is attached with an electrode member 81, urging members 68, and charge roller bearings 67L, 67R. A shaft 66*a* at both ends of the charge roller 66 is fit into the charge roller bearings 67L and 67R. The charge roller 66 is urged to the drum 62 by the urging members 68 and is rotatably supported by the charge roller bearings 67L and 67R. The charge roller 66 is driven to rotate along with rotation of the drum 62. The electrode member 81, the urging members 68, the charge roller bearing 67L and the shaft 66*a* are conductive. The electrode member 81 contacts a power supply unit (not illustrated) of the apparatus main body A, and the charge roller 66 is powered with the member serving as power supply path.

The drum 62 is integrally coupled with a flange and a flange 64 to configure an electrophotographic photosensitive drum unit (which will be referred to as a drum unit 61 below). The flange 64 is provided with an earth contact (not illustrated). The flange 63 is provided with the drive force receiving unit 63*a* for receiving a drive force from the apparatus main body A, and a flange gear 63*b* for transmitting a drive force to the development roller 32. A bearing member 76 is fixed on the drive side of the cleaning frame 71 by a screw 90, and a drum shaft 78 is pressed into and fixed on the non-drive side of the cleaning frame 71. The bearing member 76 fits with the flange 63 and the drum shaft 78 fits into a hole 64*a* of the flange 64. Thereby, the drum unit 61 is rotatably supported on the cleaning frame 71.

<Structure of Development Unit>

Figure 9:
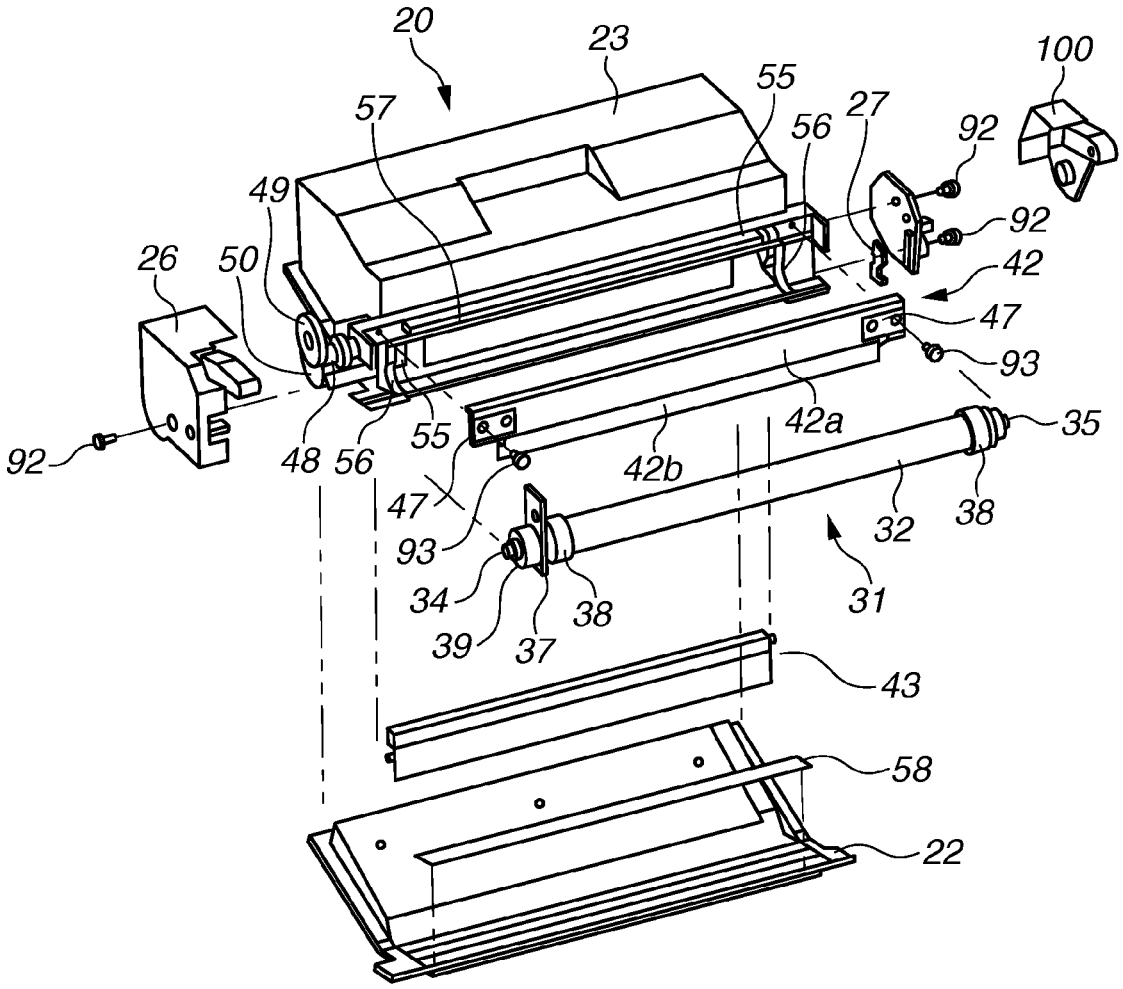
FIG. 9 is an exploded perspective view of the components of the development unit according to the first exemplary embodiment.

A structure of the development unit 20 will be described particularly with reference to FIGS. 3 and 9. FIG. 9 is an exploded perspective view of the components of the development unit 20 according to the present exemplary embodiment. A development frame formed of the development container 23 and the bottom member 22 forms the toner chamber 29 for containing a toner T therein and the toner supply chamber 28 (see FIG. 3). The bottom member 22 and the development container 23 are integrally coupled with each other by welding or the like. In the conveyance member 43, the non-drive side is supported by the development container 23 and the drive side is supported by a conveyance gear 50 attached to the development container 23. Thereby, the conveyance member 43 rotates driven by the conveyance gear 50 in the toner chamber 29. The development unit 20 is provided with a first seal member 55, a second seal member 56, and a third seal member 57 at predetermined positions of the development container 23. A fourth seal member 58 is provided at a predetermined position of the bottom member 22 to couple the development container 23 with the bottom member 22. The first seal member 55 prevents the toner T from leaking from both ends in the longitudinal direction of an elastic member 42*b* of the development blade 42. The second seal member 56 prevents the toner T from leaking from both ends in the longitudinal direction of the development roller 32. The third seal member 57 is provided in the longitudinal direction and prevents the toner T from leaking from between a support member 42*a* of the development blade 42 and the development container 23. The fourth seal member 58 is provided to contact the development roller 32 in the longitudinal direction, and prevents the toner T from leaking from the lower side of the development roller 32. The development blade 42 includes the support member 42*a* made of sheet metal and the elastic member 42*b* made of elastic material such as urethane rubber, and both ends of the support member 42*a* are fixed at predetermined positions of the development container 23 with screws 93 together with a cleaning member 47. The elastic member 42*b* contacts the development roller 32. The elastic member 42*b* regulates the amount of toner on the periphery of the development roller 32 and furthermore gives friction charges. The cleaning member 47 contacts the end surface of the development roller 32 and cleans adherents such as toner. A development roller unit 31 includes the development roller 32, the magnet roller 34, a flange 35, interval holding members 38, a bearing members 37, and development roller gears 39. The magnet roller 34 is inserted from the end on the non-drive side of the development roller 32 and the flange 35 is pressed into and fixed at the end. A conductive electrode member (not illustrated) is embedded into the flange 35 and the electrode member provided in the flange 35 contacts the development roller 32 and an electrode member 27. The electrode member 27 is fixed to the bearing member 40. The electrode member 27 contacts the power supply unit (not illustrated) of the apparatus main body A, and the development roller 32 is powered with the electrode members (not illustrated) provided on the electrode member 27 and the flange 35 serving as power supply paths.

The interval holding members 38 are attached at both ends of the development roller 32. The pair of interval holding members 38 is provided to keep a constant interval between the surface of the drum 62 and the surface of the development roller 32. The bearing member 37 is arranged outside the interval holding member 38 at the drive side, and the development roller gear 39 is incorporated further outside. The development roller 32 is rotatably supported by the bearing members 37 and 40 arranged at both ends of the pair of interval holding members 38. A first gear 48 and a second gear 49 as drive transmission members are rotatably attached to the development frame. With the structure, the flange gear 63*b* (see FIG. 8), the development roller gears 39, the first gear 48, the second gear 49, and the conveyance gear 50 sequentially mesh with each other and rotate under the drive force received from the apparatus main body A. Thereby, the development roller 32 and the conveyance member 43 are rotated. The side member 26 and the bearing member 40 are fixed to the development container 23 at both ends in the longitudinal direction by screws 92. The bearing members 37 of the development roller unit 31 are held by the side members 26.

<Structure of Force Giving Member for Giving Force to Photosensitive Unit and Development Unit>

Figure 10:
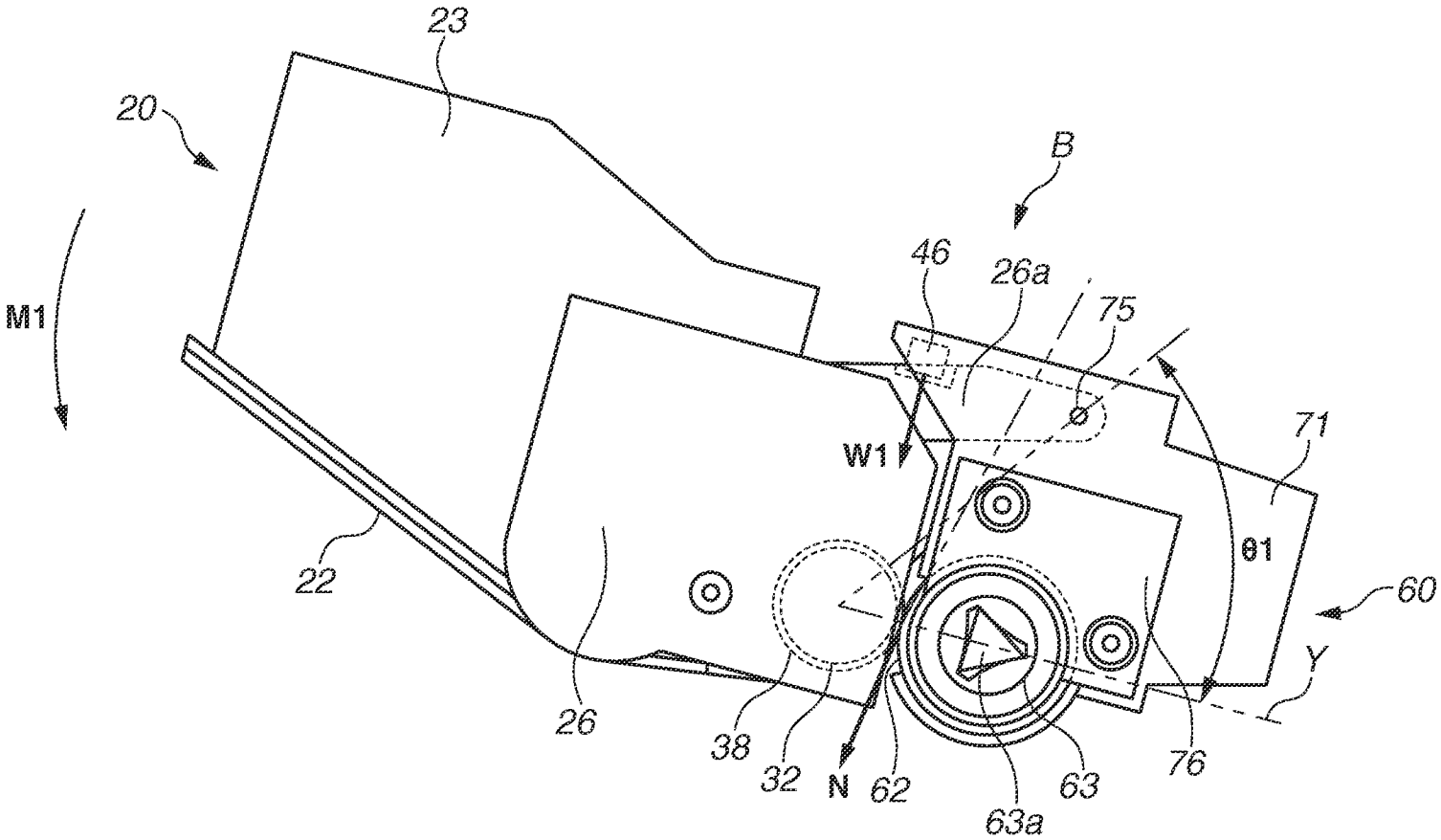
FIG. 10 is a side view of the process cartridge according to the first exemplary embodiment.
Figure 11:
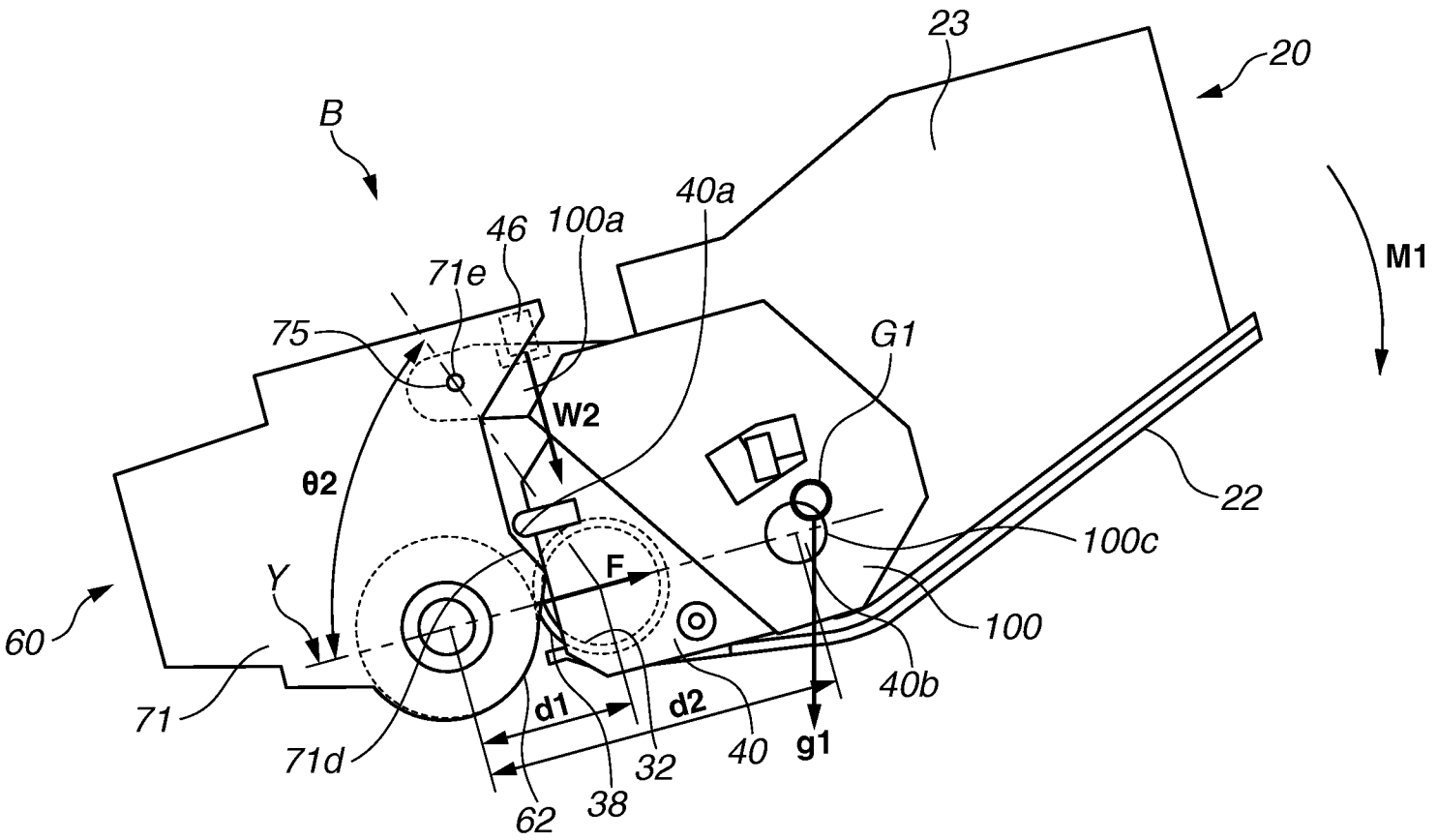
FIG. 11 is a side view of the process cartridge according to the first exemplary embodiment.

The structures of the urging members 46 as force giving members for giving a force to the photosensitive unit 60 and the development unit 20 will be described particularly with reference to FIGS. 10 and 11. FIGS. 10 and 11 are the side views of the cartridge B according to the present exemplary embodiment. FIGS. 10 and 11 are the diagrams in which the cartridge B mounted on the apparatus main body A is viewed from the sides, where FIG. 10 is a diagram viewed from the drive side and FIG. 11 is a diagram viewed from the non-drive side.

As illustrated in FIG. 10, an urging member 46 as compression spring is arranged between the photosensitive unit 60 and the development unit 20 on the drive side of the cartridge B. The urging member 46 is fixed to the side member 26 of the development unit 20 at one end, and fixed to the cleaning frame 71 of the photosensitive unit 60 at the other end. A force for rotating in the arrow M1 direction about the coupling member 75 is given to the development unit 20 by a pressing force W1 of the urging member 46.

As illustrated in FIG. 11, an urging member 46 is fixed to the arm 100*a* of the link member 100 at one end, and fixed to the cleaning frame 71 at the other end on the non-drive side of the cartridge B. A pressing force W2 is given to the link member 100 and a force for rotating in the arrow M1 direction about the coupling member 75 which is a rotational center is given to the link member 100 by the urging member 46. In the development unit 20, the force is transmitted to the shaft 40*b* engaged with the hole 100*c* of the link member 100 via the link member 100. As described above, the interval holding members 38 provided at both ends of the development roller 32 press the drum 62 by the urging members 46 provided at both ends in the longitudinal direction.

In FIGS. 10 and 11, since a self-weight of the development unit 20 may also work on the drive side and the non-drive side in the arrow M1 direction, a pressing force also changes according to consumed toner in the toner chamber 29. An urging force of the urging members 46 is set to obtain a sufficient pressing force even when the toner is consumed.

The centers of the fitting holes 71*a* and 71*e* of the cleaning frame 71 into which the coupling member 75 is fit, are the rotational centers of the development unit 20 relative to the photosensitive unit 60. The centers of the fitting holes 71*a* and 71*e* will be referred to as a "rotational center 71*a*, rotational center 71*e*" as needed, respectively. The center of the shaft 40*b* of the bearing member 40, which is the rotational center of the development unit 20 relative to the link member 100, will be referred to as a "rotational center 40*b*" as needed.

A positional relationship between the rotational center 71*a* on the drive side and the rotational centers 71*e* and 40*b* on the non-drive side will be described below. As illustrated in FIG. 10, the rotational center 71*a* on the drive side is positioned relative to the center axis of the development roller 32 on the opposite side of the extension of the arrow N. The extension of the arrow N is a meshing force direction of the gear working on the development roller gear 39 (see FIG. 9) provided at one end of the development roller 32. This is because when a gear meshing force is applied to the development unit 20, the force works in the direction (arrow M1 direction) in which the development roller 32 approaches the drum 62. That is, with the help of a gear meshing force, the development roller 32 and the drum 62 are not separated from each other. A straight line Y connecting the axial center of the drum 62 and the axial center of the development roller 32, and a straight line connecting the rotational center 71*a* and the axial center of the development roller 32 form an angle θ1.

As illustrated in FIG. 11, the straight line Y connecting the axial centers of the drum 62 and the development roller 32, and a line connecting the rotational center 71*e* and the axial center of the development roller 32 form an angle θ2. The angle θ2 is closer to 90° than the angle θ1 in the present exemplary embodiment. This is because a moment (moment in the M1 direction in the drawing) generated by the urging member 46 which works around the rotational center 71*e* increases when the angle is closer to 90°. That is, a force for pressing the drum 62 by the interval holding members 38 can more efficiently work. Further, since a gear meshing force does not need to be considered on the non-drive side, and the angle θ2 can be increased than the angle θ1 on the drive side.

The rotational center 40*b* for the link member 100 and the development unit 20 will be described below. In FIG. 11, a reaction force from the drum 62 working on the pair of interval holding members 38 provided on the development roller 32 is indicated by the arrow F. The rotational center 40*b* of the development unit 20 is provided substantially on the extension of the straight line Y connecting the axial center of the drum 62 and the axial center of the development roller 32 in the longitudinal direction. More specifically, a distance d1 between the axial center of the drum 62 and the axial center of the development roller 32 and a distance d2 between the axial center of the drum 62 and the rotational center 40*b* is expressed as d1<d2. With the structure, a moment around the rotational center 40*b* of the link member 100 given to the development unit 20 is restricted due to the reaction force F, and thus the posture of the development unit 20 is stable. In order to further stabilize the posture of the development unit 20, the rotational center 40*b* is arranged near the center of gravity G1 of the development unit 20 when the development unit 20 is installed in a posture taken at the time of image formation. More specifically, generation of a moment around the rotational center 40*b* relative to the development unit 20 is restricted thanks to a self-weight of the development unit 20.

As described above, the coupling structures and the pressing configurations of the photosensitive unit 60 and the development unit 20 are different between the drive side and the non-drive side. More specifically, the photosensitive unit 60 and the development unit 20 are rotatably coupled with each other only at the rotational center 71*a* on the drive side. In contrast, the photosensitive unit 60 and the development unit 20 are rotatably coupled with each other at two rotational centers 71*e* and 40*b* via the link member 100 on the non-drive side. In this way, the photosensitive unit 60 and the development unit 20 are coupled in a certain degree of freedom of motion on the non-drive side. Therefore, even if an error is caused in a dimension of each member including the cartridge B, either one of the interval holding members 38 provided at both ends of the development roller 32 is prevented from separating from the drum 62. Thus, a gap between the surface of the drum 62 and the surface of the development roller 32 can be kept constant in the longitudinal direction. The angle θ1 and the angle θ2 are determined so as to optimize the pressing structures of the development unit 20 on the drive side and the non-drive side. Thereby, the rotational centers 71*a* and 71*e* on the drive side and the non-drive side are not on the same axis.

<Cartridge Transportation Form>

Figure 1:
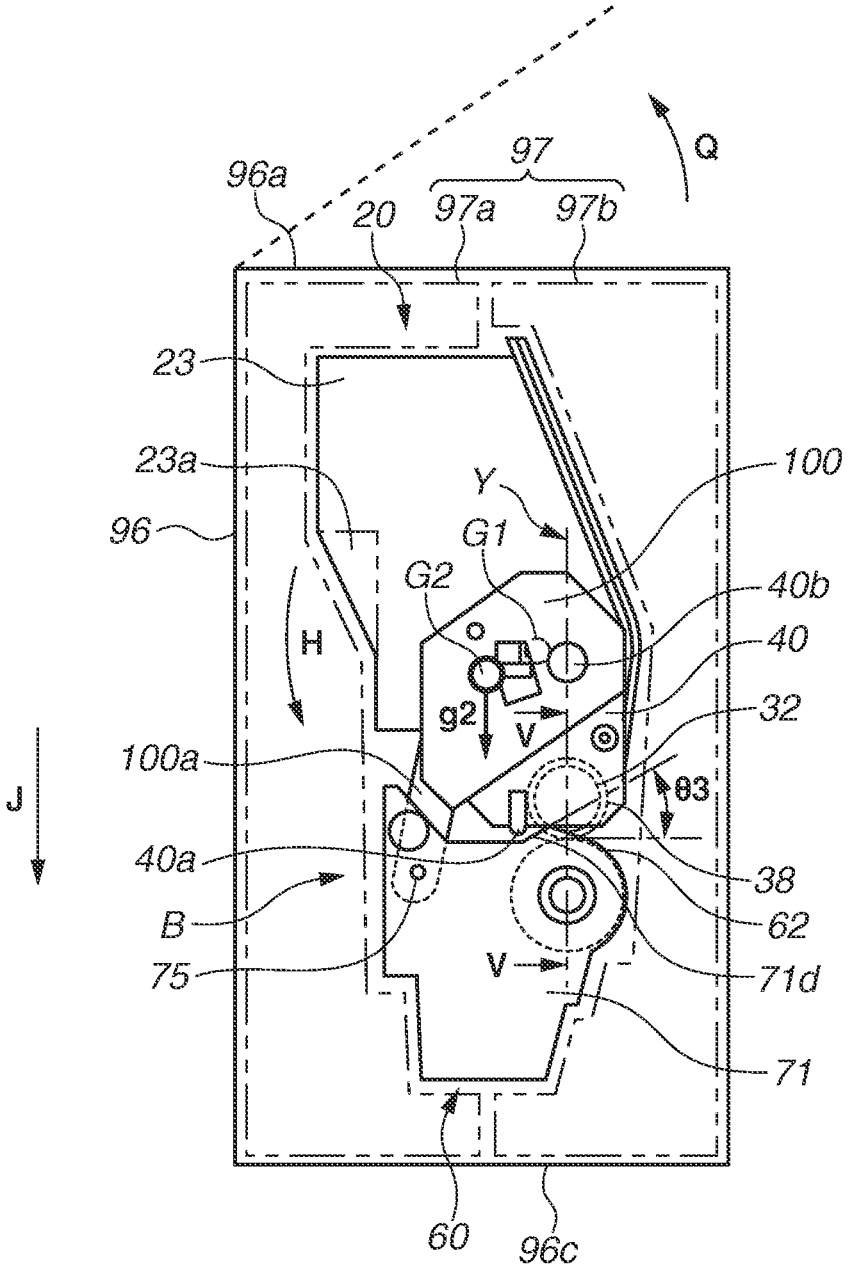
FIG. 1 is a diagram illustrating how a process cartridge according to a first exemplary embodiment is packaged.
Figure 12:
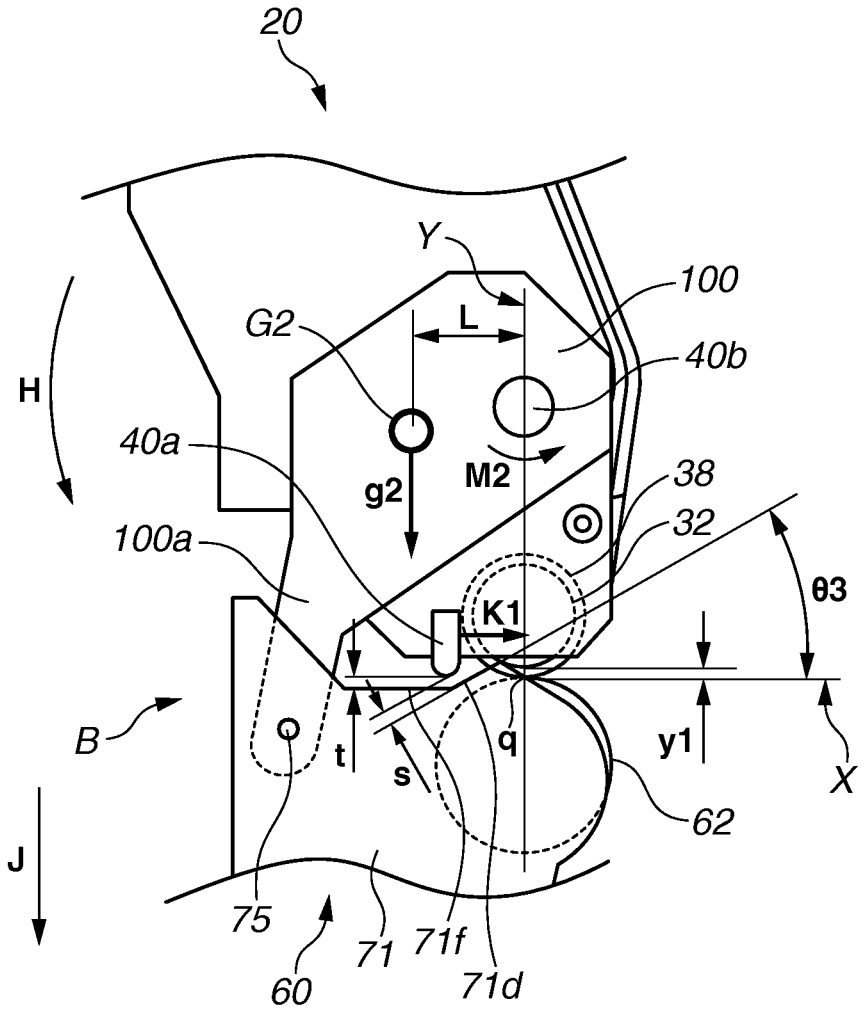
FIG. 12 is a partially enlarged side view of the process cartridge according to the first exemplary embodiment.

A transportation form of the cartridge B will be described particularly with reference to FIGS. 1 and 12. FIG. 1 is a diagram illustrating how the cartridge B according to the present exemplary embodiment is packaged, and FIG. 12 is a partially enlarged diagram thereof. In FIGS. 1 and 12, a posture of the cartridge B during transportation is illustrated in the side views as viewed from the non-drive side.

The cartridge B is packaged in an individual box 96 one by one. The individual box 96 is handled such that the top face 96*a* is positioned on the upper side in the vertical direction and the bottom face 96*c* is positioned on the lower side when the cartridge B is transported. The cartridge B is packaged in the individual box 96 in a posture in which the development unit 20 faces the top face 96*a* and the photosensitive unit 60 faces the bottom face 96*c*. A buffer material such as foaming agent, or a buffer material 97 made of a vacuum-shaped resin member like eggbox, is arranged in the gaps between the cartridge B and the individual box 96 to alleviate a drop impact. When the box is opened, the top face 96*a* of the individual box 96 is opened in the arrow Q direction and the cartridge B is taken out together with the buffer material 97 from the grip part 23*a* provided on the development unit 20 of the cartridge B. Further, the cartridge B is taken out while the buffer material 97 made of two parts 97*a* and 97*b* are opened from the grip part 23*a* side and the grip part 23*a* is being gripped. With the structure, the cartridge B is taken out and can be mounted on the apparatus main body A as illustrated in FIG. 4.

<Behaviors of Cartridge on Drop Impact>

Figure 13:
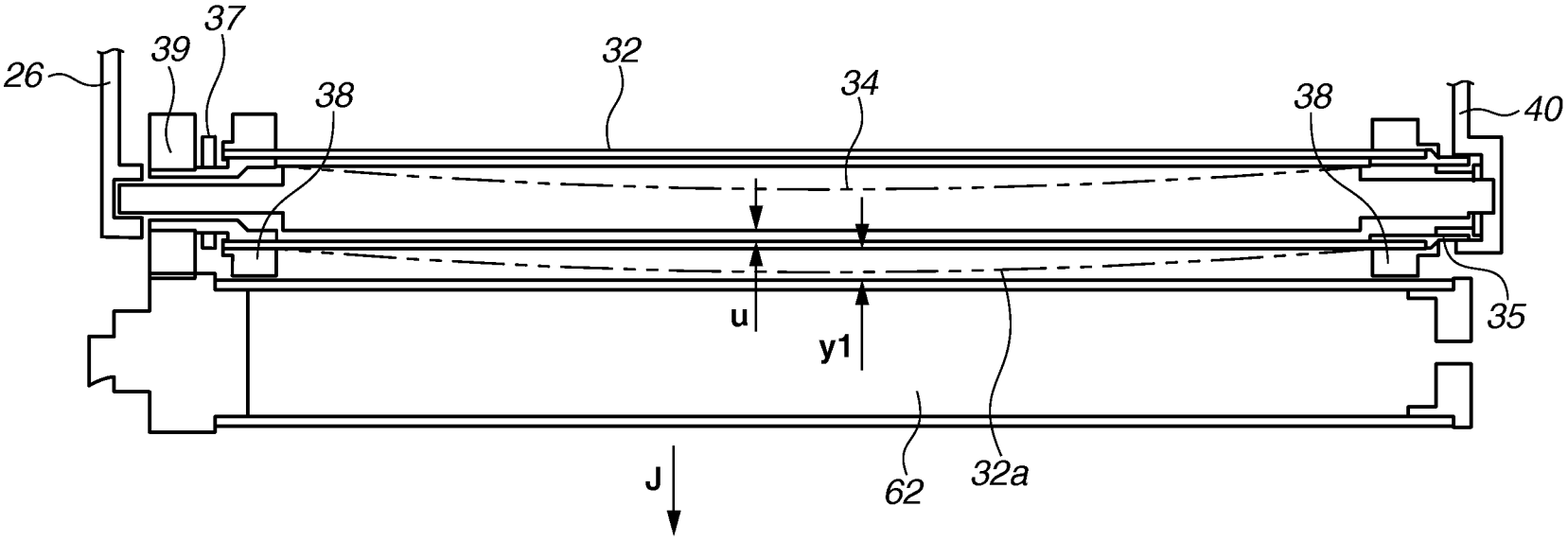
FIG. 13 is an explanatory diagram of a positional relationship between the photosensitive drum and the development roller according to the first exemplary embodiment.

Behaviors of the cartridge B subjected to an impact when the packaged cartridge B is dropped will be described particularly with reference to FIGS. 1, 12, and 13. FIG. 13 is a diagram for describing a positional relationship between the drum 62 and the development roller according to the present exemplary embodiment, and illustrates a positional relationship between the drum 62 and the development roller 32 in a posture taken at the time of transportation of the cartridge B in a cross section (V-V cross section of FIG. 1). When the cartridge B is dropped in the arrow J direction during transportation while it is packaged as illustrated in FIG. 1, the cartridge B is subjected to an impact from the bottom face 96*c*.

The development unit 20 is on the top face 96*a* side while the cartridge B is packaged as illustrated in FIG. 1, and thus the development roller 32 is positioned above the drum 62. At this time, as illustrated in FIG. 13, a predetermined gap (which will be referred to as second gap y1 below) is formed between the surface of the development roller 32 and the surface of the drum 62. When the cartridge B is dropped in the arrow J direction, its center bends as in an imaginary line 32*a* under its own weight since the development roller 32 is supported at both ends by the interval holding members 38 (see FIG. 13). In addition, the magnet roller 34 is provided within the development roller 32 with a gap u between the inner periphery of the development roller 32 and the magnet roller 34. The magnet roller 34 bends due to a drop impact, and therefore the development roller 32 is pressed from inside and is subjected to a more bending force. Such a phenomenon is conspicuous when a diameter of the development roller 32 is reduced to downsize the cartridge B and its rigidity is lowered. When the development roller 32 bends beyond the second gap y1, it collides with the drum 62 and the surface of the drum 62 may be damaged. If the surface of the drum 62 is damaged, an image failure such as generation of a line may be caused.

The drum 62 may be positioned on the lower side of the development roller 32 in the vertical direction depending on a posture during transportation. Thus, when individual the box 96 drops in the direction of the bottom face 96*c*, a collision between the development roller 32 and the drum 62 easily occurs due to the bent development roller 32. That is, when the individual box 96 drops in a direction of the other face, the direction in which the development roller 32 bends is not toward the drum 62, and thus the collision rarely occurs. Therefore, as illustrated in FIG. 2, when the image forming apparatus is dropped during its transportation while the cartridge B is mounted on the apparatus main body A, a collision between the development roller 32 and the drum 62 due to the bent development roller 32 rarely occurs.

<Structure and Mechanism for Restricting Collision on Drum Surface Even if Development Roller Bends>

Figure 14:
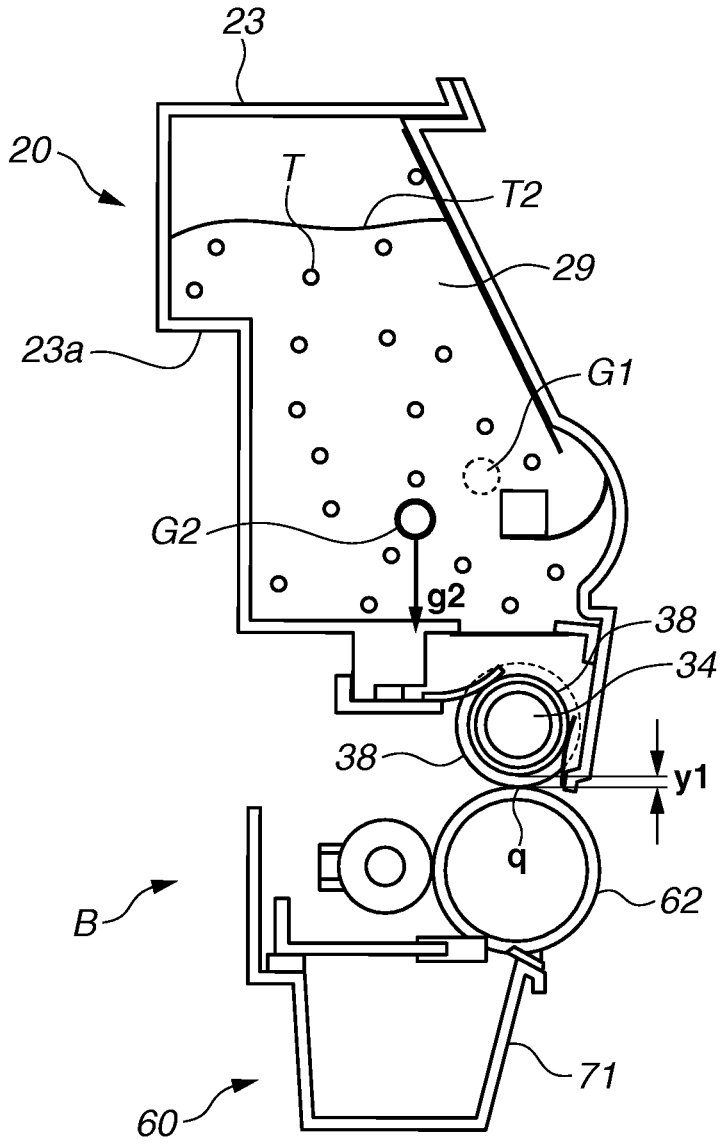
FIG. 14 is a schematic cross-section view of the process cartridge according to the first exemplary embodiment.
Figure 15B:
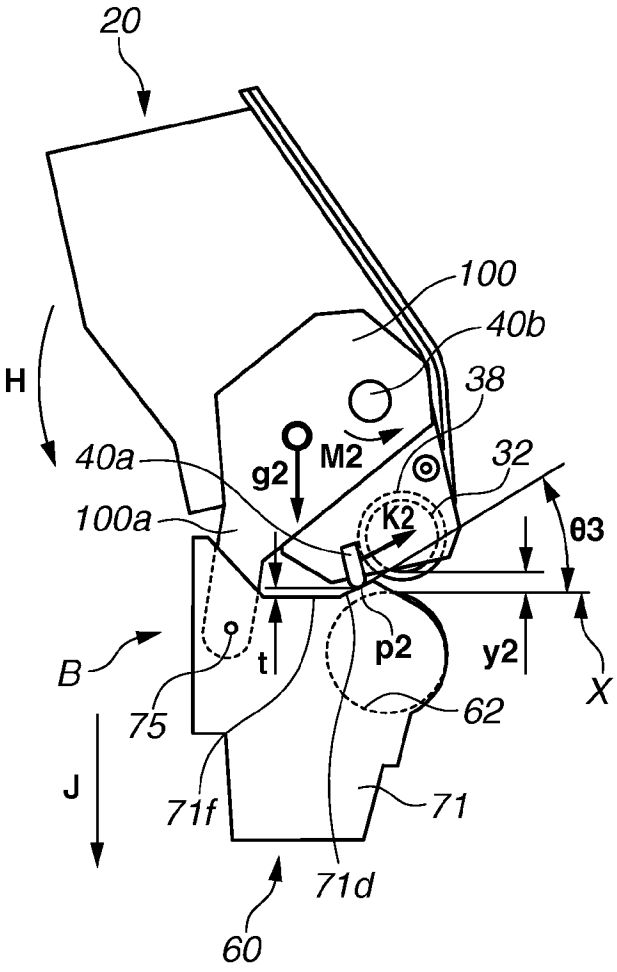
FIGS. 15A and 15B are the side views of the process cartridge according to the first exemplary embodiment.
Figure 15A:
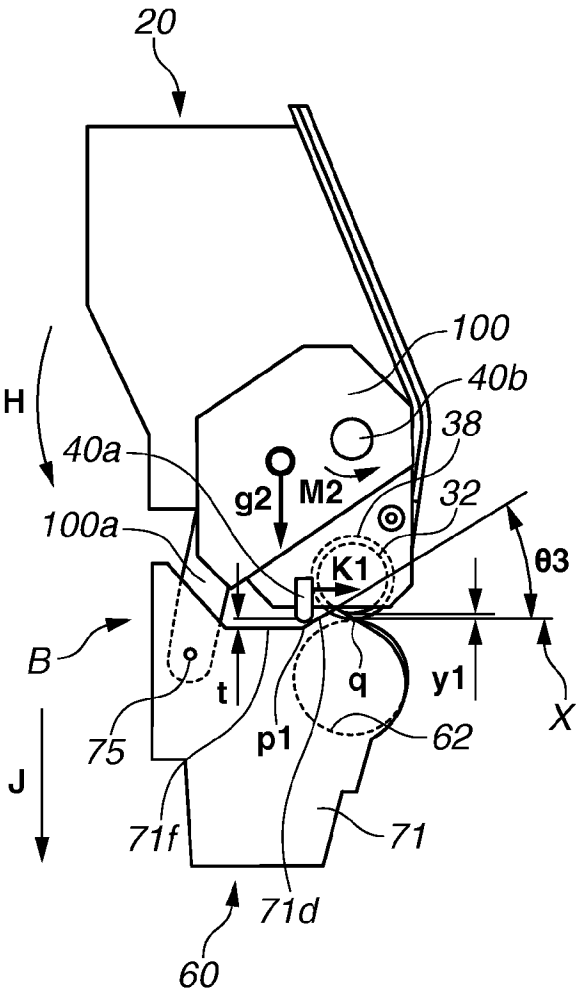

A structure and mechanism for restricting a collision on the surface of the drum 62 due to a drop impact even if the development roller 32 bends will be described particularly with reference to FIGS. 1 and 12 to 15B. FIG. 14 is a schematic cross-section view of the cartridge B according to the present exemplary embodiment, and illustrates a cross section of a posture taken during transportation (while the cartridge B is not subjected to an external force). FIGS. 15A and 15B are the side views of the cartridge B according to the present exemplary embodiment. FIGS. 15A and 15B illustrate the operations of the development unit 20 when the cartridge B is subjected to a drop impact as viewed from the non-drive side.

The cartridge B is provided with guide units for guiding the development unit 20 in a direction in which the development roller 32 separates from the drum 62 when the cartridge B is subjected to an impact at one end of the photosensitive unit 60 (non-drive side) and at one end of the development unit 20. The guide units according to the present exemplary embodiment are a protrusion 40*a* provided on the development unit 20 and a guide face 71*d* provided on the photosensitive unit 60. The protrusion 40*a* and the guide face 71*d* are separated from each other when an external force does not work on the cartridge B. When the cartridge B is subjected to an impact in a direction in which the development roller 32 approaches the drum 62, the development unit 20 rotates relative to the link member 100 so that the protrusion 40*a* and the guide face 71*d* contact each other. Thereby, a movement direction of the protrusion 40*a* is guided by the guide face 71*d* so that the development unit 20 is guided in a direction in which the development roller 32 is separated from the drum 62.

The structures of the guide units and a mechanism for guiding movements of the development unit 20 by the guide units will be more specifically described. As described above, the bearing member 40 is integrally provided on the non-drive side of the development unit 20. The bearing member 40 is provided with the protrusion 40*a* protruding toward the photosensitive unit 60 while the development unit 20 is coupled with the photosensitive unit 60. The cleaning frame 71 of the photosensitive unit 60 is formed with a plane 71*f* and the planar guide face 71*d* tilted relative to the plane 71*f* opposing the development unit 20 while the development unit 20 is coupled with the photosensitive unit 60. The plane 71*f* opposes the protrusion 40*a* having a gap t while an external force does not work on the cartridge B (see FIG. 12).

When the cartridge B is viewed in the longitudinal direction, a point where the interval holding member 38 provided on the development roller 32 contacts the drum 62 is taken as point q. When viewed in the longitudinal direction at the point q, a line orthogonal to the straight line Y connecting the axial center of the development roller 32 and the axial center of the drum 62 is taken as straight line X. The guide face 71*d* is formed in a plane at an angle θ3 relative to the straight line X. While an external force does not work on the cartridge B, a predetermined gap (which will be referred to a first gap s below) is formed between the protrusion 40*a* and the guide face 71*d*. In this way, while an external force does not work on the cartridge B, the first gap s is formed between the protrusion 40*a* and the guide face 71*d* and the second gap y1 is formed between the surface of the development roller 32 and the surface of the drum 62. A posture of the development unit 20 in this state is referred to as "first posture."

A position of the center of gravity of the development unit 20 will be described herein. In a new cartridge B, a toner T filled in the toner chamber 29 accounts for most of the weight of the development unit 20. As described above, when the apparatus main body A forms an image, the center of gravity of the development unit 20 is at a position G1 near the rotational center 40*b* (see FIG. 11). At this time, a surface position of the toner T in the toner chamber 29 is T1 (see FIG. 3). On the other hand, while the cartridge B is packaged, the surface position of the toner T moves to T2 as the toner T moves. Therefore, in the packaged state, the center of gravity of the development unit 20 also moves from G1 to G2 (FIG. 14). The cartridge B in the packaged state is as a premise s a new one, that is, the cartridge B is filled up with the toner T.

When the cartridge B is dropped in the arrow J direction and is subjected to an impact from the bottom face 96*c*, the development unit 20 rotates about the rotational center 40*b* in the arrow H direction shown in the drawing (see FIGS. 1 and 12). This is because the position of the center of gravity G2 is away from a vertical straight line passing through the rotational center 40*b* of the development unit 20 by a distance L and the development unit 20 is given a rotational moment M2 about the rotational center 40*b* due to the self-weight working in the arrow g2 direction. The interval holding member 38 provided on the development roller 32 contacts the drum 62 at the point q, and thus when it is given the moment M2 in the rotation direction, the development unit 20 moves in the straight line X direction. Thus, the protrusion 40*a* of the development unit 20 moves together with the development unit 20 in the arrow K1 direction parallel to the straight line X. As illustrated in FIG. 15A, the protrusion 40*a* and the guide face 71*d* contact each other at the contact point p1 along with rotation of the development unit 20. At this time, the interval holding members 38 is kept in contact with the drum 62 and the second gap y1 between the surface of the development roller 32 and the surface of the drum 62 is maintained. The development unit 20 moves in the arrow K1 direction and the interval holding members 38 move along the drum 62, and thus the gap t between the plane 71*f* and the protrusion 40*a* slightly decreases. However, the gap between the plane 71*f* and the protrusion 40*a* is maintained and does not hinder a contact between the protrusion 40*a* and the guide face 71*d*.

When the development unit 20 further rotates in the H direction, as illustrated in FIG. 15B, the protrusion 40*a* moves along the guide face 71*d* and thus the development unit 20 moves in the arrow K2 direction shown in the drawing. The guide face 71*d* has the angle θ3 relative to the straight line X as described above. Therefore, when the development unit 20 moves along the guide face 71*d*, the interval holding members 38 and the drum 62 separate from each other. Thereby, the gap between the surface of the development roller 32 and the surface of the drum 62 is larger than the second gap y1. The gap will be referred to as "third gap y2." In this way, when the cartridge B is subjected to an impact, the protrusion 40*a* and the guide face 71*d* contact each other (gap s=0) and the protrusion 40*a* is guided by the guide face 71*d*. Thereby, the third gap y2 between the surface of the development roller 32 and the surface of the drum 62 is larger than the second gap y1. When the cartridge B is subjected to an impact, a posture of the development unit 20 for avoiding a contact between the development roller 32 and the drum 62 in this way is referred to as "second posture."

<Advantageous Effects of Cartridge and Image Forming Apparatus According to Present Exemplary Embodiment>

As described above, according to the present exemplary embodiment, when the cartridge B is subjected to a drop impact, the center of the development roller 32 tends to bend in a direction to collide with the surface of the drum 62. However, at the same time, the development unit 20 rotates in the H direction about the rotational center 40*b* to let out a force applied to the development roller 32. When the development unit 20 further rotates, the protrusion 40*a* of the development unit 20 contacts the guide face 71*d* of the cleaning frame 71. When the development unit 20 then moves in the arrow K2 direction along the guide face 71*d*, the interval holding members 38 moves to separate from the surface of the drum 62. Thereby, even if the development roller 32 bends due to a drop impact, the interval between the surface of the development roller 32 and the surface of the drum 62 becomes wider and thus a collision between the development roller 32 and the drum 62 can be restricted. Even if an unexpected impact is applied to be bent by a large amount and the development roller 32 and the drum 62 contact each other, a collision therebetween can be alleviated and the surface of the drum can be prevented from being damaged. Thereby, a deterioration in quality of an image formed by the image forming apparatus can be restricted.

As described above, in the present exemplary embodiment, a collision between the development roller 32 and the drum 62 can be restricted without the need of providing a protective sheet only for transportation and without the need of providing a highly-functional buffer material or a large buffer material. Therefore, the number of components does not need to be increased and the number of assembly steps does not need to be increased. In the present exemplary embodiment, a collision between the development roller 32 and the drum 62 can be restricted only by simple form changes of the two members such as the protrusion 40*a* provided on the development unit 20 and the guide face 71*d* provided on the photosensitive unit 60.

In the present exemplary embodiment, the rotational center 40*b* of the development unit 20 relative to the link member 100 is arranged away from the development roller 32 (see d1<d2 in FIG. 11). In this way, as the rotational center 40*b* is farther away from the development roller 32, the protrusion 40*a* and the guide face 71*d* can contact with each other in the development unit 20 rotating at a smaller angle when an impact is applied to the cartridge B. Thereby, a twist of the cartridge B between the drive side and the non-drive side can be restricted and a deformation of the frame can be restricted.

In the present exemplary embodiment, there has been demonstrated the case in which the guide units for guiding the development unit 20 in a direction in which the development roller 32 separates from the drum 62 when the cartridge B is subjected to an impact are the protrusion 40*a* of the development unit 20 and the guide face 71*d* of the photosensitive unit 60. However, the guide units according to exemplary embodiment of the present invention are not limited thereto. That is, a protrusion may be provided at one of the photosensitive unit and the development unit and a guide face may be provided at the other thereby to embody the guide units. Therefore, a protrusion may be provided on the photosensitive unit 60 and a guide face may be provided on the development unit 20. Also in this case, the development unit 20 can be guided in a direction in which the development roller 32 separates from the drum 62 when the cartridge B is subjected to an impact. In the present exemplary embodiment, there has been demonstrated the case in which the guide face 71*d* is planar. However, even if the guide face is curved, the development unit 20 can be guided in a direction in which the development roller 32 separates from the drum 62 when the cartridge B is subjected to the impact.

Figure 16:
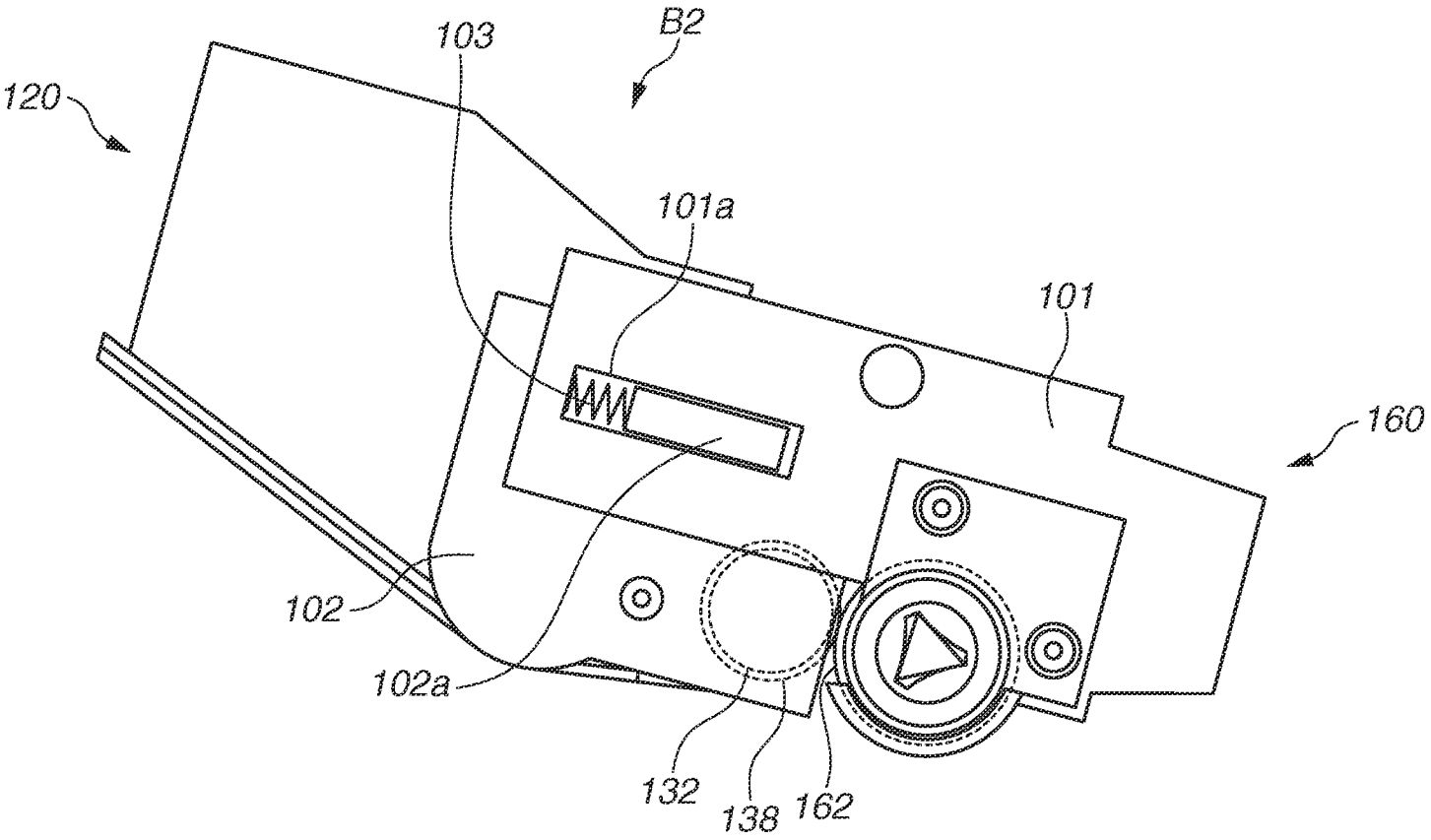
FIG. 16 is a side view of a process cartridge according to a second exemplary embodiment.

FIG. 16 illustrates a second exemplary embodiment of the present invention. The first exemplary embodiment has described the case in which the photosensitive unit and the development unit are rotatably coupled one rotational center with each other at the other end in the longitudinal direction. In contrast, the present exemplary embodiment will demonstrate a structure in which the photosensitive unit and the development unit are slidably coupled with each other at the other end in the longitudinal direction. Other constituents and operations are the same as in the first exemplary embodiment, and thus the description of the same constituents will be omitted.

FIG. 16 is a side view of a cartridge B2 according to the present exemplary embodiment. FIG. 16 is a side view from the drive side. The cartridge B2 according to the present exemplary embodiment includes a photosensitive unit 160 and a development unit 120 which are coupled with each other similar to the first exemplary embodiment. A coupling structure of the photosensitive unit 160 and the development unit 120 at one end (non-drive side) in the longitudinal direction is the same as in the first exemplary embodiment, and thus the description thereof will be omitted. A structure of the photosensitive unit 160 and a structure of the development unit 120 are the same as in the first exemplary embodiment except the coupling structure at the other end (drive side) in the longitudinal direction, and thus the description thereof will be omitted. That is, in the present exemplary embodiment, only the coupling structure of the photosensitive unit 160 and the development unit 120 at the other end (drive side) in the longitudinal direction is different from that of the first exemplary embodiment. Therefore, only the coupling structure will be described below.

In the photosensitive unit 160 according to the present exemplary embodiment, a cleaning frame 101 is provided with a guide unit 101*a* formed in a rectangular hole. A bearing member 102 of the development unit 120 is provided with a guided unit 102*a* formed in a substantially cuboid protrusion. When the development unit 120 and the photosensitive unit 160 are coupled with each other, the guided unit 102*a* provided in the bearing member 102 is inserted into the guide unit 101*a* provided on the cleaning frame 101. Further, an urging member 103 which is a force giving member as compression spring is attached within the guide unit 101*a*. A force is given to the development unit 120 and the photosensitive unit 160 by the urging member 103 in a direction in which the drum 162 and the development roller 132 approach each other. More specifically, the development unit 120 is slidably supported on the photosensitive unit 160 and is urged toward the photosensitive unit 160 on the drive side in the longitudinal direction. Interval holding members 138 provided at both ends of the development roller 132 of the development unit 120 press the drum 162. Thereby, a gap between the surface of the development roller 132 and the surface of the drum 162 is maintained.

Similar effects as the first exemplary embodiment can be obtained in the cartridge B2 with the above structure.

The effects of each exemplary embodiment described above are as follows. With the structure demonstrated in each exemplary embodiment, an increase in cost can be restricted and a collision between the development roller and the photosensitive drum can be restricted without increasing the number of components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-090507, filed Apr. 24, 2014, which is hereby incorporated by reference herein in its entirety.

What is claimed is:

1. A process cartridge attachable/detachable to/from an apparatus main body of an electrophotographic image forming apparatus, comprising:

a photosensitive unit having a photosensitive drum;

a development unit having a development roller for developing an electrostatic latent image formed on the photosensitive drum; and force giving members configured to give a force to the photosensitive unit and the development unit in a direction in which the photosensitive drum and the development roller approach each other, the process cartridge being configured such that the photosensitive unit and the development unit are coupled with each other at both ends in a direction parallel to a rotational center axis line of the photosensitive drum, wherein the photosensitive unit and the development unit are coupled with each other by a link member rotatably supported on the photosensitive unit and rotatably supported also on the development unit at one end in the direction parallel to the rotational center axis line, wherein guide units are provided at one end of the photosensitive unit and at one end of the development unit, which are separated from each other when an external force does not work on the process cartridge, and wherein when the process cartridge is subjected to an impact in a direction in which the development roller approaches the photosensitive drum, the guide units are brought into contact with each other while the development unit rotates relative to the link member, and are configured to guide the development unit in a direction in which the development roller separates from the photosensitive drum.

2. The process cartridge according to claim 1, wherein the guide units are a protrusion provided at one of the photosensitive unit and the development unit, and a guide face provided at the other, a first gap is formed between the protrusion and the guide face and a second gap is formed between the surface of the development roller and the surface of the photosensitive drum in a first posture of the development unit when an external force does not work on the process cartridge, and the protrusion and the guide face contact each other and, a third gap larger than the second gap is formed between the surface of the development roller and the surface of the photosensitive drum in a second posture of the development unit when the process cartridge is subjected to an impact in a direction in which the development roller approaches the photosensitive drum.

3. The process cartridge according to claim 1, wherein a rotational center of the development unit relative to the link member is provided substantially on the extension of a line connecting the axial center of the photosensitive drum and the axial center of the development roller as viewed in the direction parallel to the rotational center axis line.

4. The process cartridge according to claim 1, wherein when a new process cartridge is packaged such that the development unit is arranged above the photosensitive unit in the vertical direction, the center of gravity of the development unit is positioned such that if the process cartridge is subjected to an impact in a direction in which the development roller approaches the photosensitive drum, the development unit rotates relative to the link member in a direction in which the guide units provided at one end of the photosensitive unit and at one end of the development unit approach each other.

5. The process cartridge according to claim 1, wherein the photosensitive unit and the development unit are rotatably coupled with each other only at one rotational center at the other end in the direction parallel to the rotational center axis line.

6. The process cartridge according to claim 1, wherein the photosensitive unit and the development unit are slidably coupled with each other at the other end in the direction parallel to the rotational center axis line.

7. An electrophotographic image forming apparatus comprising:

a process cartridge according to claim 1; and an apparatus main body to/from which the process cartridge is attachable/detachable.

8. The electrophotographic image forming apparatus according to claim 7, wherein the guide units are a protrusion provided at one of the photosensitive unit and the development unit, and a guide face provided at the other, a first gap is formed between the protrusion and the guide face and a second gap is formed between the surface of the development roller and the surface of the photosensitive drum in a first posture of the development unit taken when an external force does not work on the process cartridge, and the protrusion and the guide face contact each other and, a third gap larger than the second gap is formed between the surface of the development roller and the surface of the photosensitive drum in a second posture of the development unit taken when the process cartridge is subjected to an impact in a direction in which the development roller approaches the photosensitive drum.

9. The electrophotographic image forming apparatus according to claim 8, wherein a rotational center of the development unit relative to the link member is provided substantially on the extension of a line connecting the axial center of the photosensitive drum and the axial center of the development roller as viewed in a direction parallel to the rotational center axis line.

10. The electrophotographic image forming apparatus according to claim 9, wherein when a new process cartridge is packaged such that the development unit is arranged above the photosensitive unit in the vertical direction, the center of gravity of the development unit is positioned such that the development unit rotates relative to the link member in a direction in which the guide units provided at one end of the photosensitive unit and at one end of the development unit approach each other if the process cartridge is subjected to an impact in a direction in which the development roller approaches the photosensitive drum.

11. The electrophotographic image forming apparatus according to claim 10, wherein the photosensitive unit and the development unit are rotatably coupled with each other only at one rotational center at the other end in the direction parallel to the rotational center axis line.

12. The electrophotographic image forming apparatus according to claim 11, wherein the photosensitive unit and the development unit are slidably coupled with each other at the other end in the direction parallel to the rotational center axis line.

* * * * *